US009874133B2

(12) United States Patent
Maier et al.

(10) Patent No.: US 9,874,133 B2
(45) Date of Patent: Jan. 23, 2018

(54) INTERNAL COMBUSTION ENGINE, IN PARTICULAR LARGE DIESEL ENGINE

(71) Applicant: AVL LIST GMBH, Graz (AT)

(72) Inventors: Gerhard Maier, Wagersbach (AT); Rene Kögl, Weinburg (AT)

(73) Assignee: AVL List GmbH, Graz (AT)

( * ) Notice: Subject to any disclaimer, the term of this patent is extended or adjusted under 35 U.S.C. 154(b) by 557 days.

(21) Appl. No.: 14/410,721

(22) PCT Filed: Jun. 19, 2013

(86) PCT No.: PCT/EP2013/062804

§ 371 (c)(1),
(2) Date: Mar. 11, 2015

(87) PCT Pub. No.: WO2014/001181

PCT Pub. Date: Jan. 3, 2014

(65) Prior Publication Data

US 2015/0211408 A1 Jul. 30, 2015

(30) Foreign Application Priority Data

Jun. 26, 2012 (AT) ..... A 50248/2012

(51) Int. Cl.
*F01P 3/02* (2006.01)
*F02F 1/16* (2006.01)
(Continued)

(52) U.S. Cl.
CPC ..... *F01P 3/02* (2013.01); *F01P 3/14* (2013.01); *F01P 7/165* (2013.01); *F02F 1/16* (2013.01);
(Continued)

(58) Field of Classification Search
CPC .. F01P 3/02; F01P 2003/021; F01P 2003/024; F01P 2003/027;
(Continued)

(56) References Cited

U.S. PATENT DOCUMENTS 3,444,845 A * 5/1969 Scheiterlein ..... F01P 3/02 123/41.29
4,106,444 A 8/1978 Deutschmann et al.
4,815,419 A * 3/1989 Kitada ..... F01P 3/02 123/41.42
(Continued)

FOREIGN PATENT DOCUMENTS

AT 000092 1/1995
DE 102004047452 4/2006
(Continued)

OTHER PUBLICATIONS

English Abstract of DE102004047452.
English Abstract of DE102011101337.
English Abstract of JP S5865927.

*Primary Examiner* — Jacob Amick
(74) *Attorney, Agent, or Firm* — Dykema Gossett PLLC

(57) ABSTRACT

The invention relates to an internal combustion engine, in particular a large diesel engine, having at least a first and a second cooling circuit (31, 32), having at least one individual cylinder (1) with a cylinder housing (2) which accommodates a cylinder liner (3), and having at least one individual cylinder head (4), wherein the cylinder liner (3) is surrounded by at least one cooling jacket (5, 6) which is flow-connected to at least one cooling chamber (14) in the individual cylinder head (4), the cylinder liner (3) is surrounded by a first and a second cooling jacket (5, 6), wherein the first cooling jacket (5) is separated in flow terms from the second cooling jacket (6) within the cylinder housing (2). In order to make high degrees of efficiency and low exhaust-gas values possible, it is proposed that the first cooling jacket (5) is flow-connected to at least a first cooling chamber (14) and the second cooling jacket (6) is flow-connected to at least a second cooling chamber (24) in the individual cylinder head (4).

42 Claims, 3 Drawing Sheets

(51) Int. Cl.

| | |
|---|---|
| ***F01P 7/16*** | (2006.01) |
| ***F02F 1/38*** | (2006.01) |
| ***F01P 3/14*** | (2006.01) |
| ***F02F 1/36*** | (2006.01) |
| *F02F 1/24* | (2006.01) |

(52) U.S. Cl.
CPC ..... *F02F 1/36* (2013.01); *F02F 1/38* (2013.01); *F01P 2003/028* (2013.01); *F01P 2060/02* (2013.01); *F02F 1/242* (2013.01)

(58) Field of Classification Search
CPC ..... F01P 2003/028; F01P 3/16; F01P 3/14; F01P 7/165; F02F 1/36; F02F 1/38; F01F 1/16
See application file for complete search history.

(56) References Cited

U.S. PATENT DOCUMENTS

| | | | | |
|---|---|---|---|---|
| 6,340,006 | B1 | 1/2002 | Malatto et al. | |
| 6,349,697 | B1 * | 2/2002 | Kanda ..... | F02F 3/26 123/295 |
| 7,806,091 | B2 | 10/2010 | Esau et al. | |

FOREIGN PATENT DOCUMENTS

| | | |
|---|---|---|
| DE | 102011101337 | 12/2011 |
| JP | S5837920 | 3/1983 |
| JP | S5865927 | 4/1983 |
| JP | 0660745 | 8/1994 |
| JP | H0660745 | 8/1994 |

* cited by examiner 1
21
4
14
27
29
25
20
26
28
13
43
18
12
16
17
15
ε
6
11
6a
24
23
22
6
NT
10
1a
8
9
7
5
5a
2
HT
3
5
1
14
27
21
29
28
13
25
12
20
11
22
6
7
3
5
1a

INTERNAL COMBUSTION ENGINE, IN PARTICULAR LARGE DIESEL ENGINE

BACKGROUND OF THE INVENTION

Field of the Invention

The invention relates to an internal combustion engine, especially a large diesel engine, comprising at least one first and one second cooling circuit, at least one single cylinder with a cylinder housing which accommodates a cylinder liner, and at least one single-cylinder head, wherein the cylinder liner is surrounded by at least one cooling jacket which is flow-connected to at least one cooling chamber in the single-cylinder head, the cylinder liner is surrounded by a first and second cooling jacket, wherein the first cooling jacket is separated with respect to flow from the second cooling jacket within the cylinder housing.

The Prior Art

A cooling system of an internal combustion engine with a first cooling circuit of a cylinder head and a second cooling circuit of an engine block which are connected to each other is known from DE 10 2004 047 452 A1. A controllable actuating means for controlling a division of a coolant flow is present between the first and second cooling circuit.

A similar cooling system with a first cooling circuit for cooling the cylinder head and a second cooling circuit for cooling the cylinder block is known from EP 1 035 306 A2.

DE 10 2004 024 289 A1 describes a cooling system for a vehicle with a high-temperature circuit and a low-temperature circuit. The high-temperature circuit is provided for cooling the internal combustion engine, and the low-temperature circuit is used for cooling an intercooler and optionally an oil cooler.

A circuit arrangement with a low-temperature circuit for cooling auxiliary units of an internal combustion engine and a high-temperature circuit for cooling the internal combustion engine and further auxiliary units is also known from DE 10 2011 101 337 A1.

JP 06-60745 U discloses an internal combustion engine comprising at least one cylinder with a cylinder housing accommodating a cylinder liner and a cylinder head, wherein the cylinder liner is surrounded by a first and second cooling jacket, wherein the first cooling jacket is flow-connected to a cooling chamber in the cylinder head. The first cooling jacket is separated from the second cooling jacket with respect to flow within the cylinder housing. Similar internal combustion engines are also known from JP 55-057614 A or JP 58-65927 A.

It is further known to use a separate cooling circuit in large engines for the cooling of the valve seat rings.

Based on the requirement of operating current large engines with increasingly improved efficiencies and low emissions, it is necessary to adjust the mean-pressure and ignition-pressure potentials of the internal combustion engines to the improved supercharging technology (two-step supercharging). This means that more heat than before needs to be dissipated in the region of the cylinder liner and the fire deck of the cylinder head.

It is the object of the invention to improve the dissipation of heat in large engines in the region of the fire deck and the cylinder liner.

SUMMARY OF THE INVENTION

This is achieved in accordance with the invention in such a way that the first cooling jacket is flow-connected to at least one first cooling chamber and the second cooling jacket is flow-connected to at least one second cooling chamber in the single-cylinder head.

In order to achieve effective cooling of the top land ring of the cylinder liner, it is advantageous if the first cooling jacket is flow-connected to at least one preferably annular first cooling channel, which surrounds the top land region of the cylinder liner, via at least one preferably annular first flow transfer within the cylinder housing. The first cooling channel is preferably arranged at least in part, preferably predominantly, between the first cooling jacket and the single-cylinder head. This allows outstanding cooling of the cylinder in the top land ring region, especially when the cylinder liner comprises at least one radial blind hole originating from the cooling channel, a radial through-hole or preferably tangential milled recess.

The first cooling channel is flow-connected via at least one transfer opening between the cylinder housing and the single-cylinder head to the first cooling chamber in the single-cylinder head.

The first cooling jacket can be formed in part by the cylinder housing surrounding the cylinder liner, and partly by the cylinder liner itself, wherein preferably the second cooling jacket is formed by the single-cylinder housing. Especially good cooling of the top land ring region is further obtained when the second cooling jacket substantially surrounds the first cooling channel.

In order to optimally cool the region of the fire deck of the single-cylinder head independently of the cylinder housing, it is provided within the scope of the invention that the second cooling jacket is flow-connected via at least one preferably annular second overflow opening between the cylinder housing and the single-cylinder head to at least one second cooling chamber in the single-cylinder head.

The second cooling chamber preferably comprises at least one annular second cooling channel surrounding a valve seat ring and at least one axial connecting channel adjacent to a central component opening into the combustion chamber, preferably an injector, as well as radial connecting channels between the second and third cooling channels and radial connecting boreholes in the fire deck of the single-cylinder head, said connecting boreholes leading to the second cooling channels or axial connecting channels, wherein preferably the components of the second cooling chamber are arranged at least predominantly in a normal plane on the cylinder axis in the fire deck of the single-cylinder head.

It can further be provided that the axial connecting channel is flow-connected to at least one partial cooling chamber in the single-cylinder head arranged between the first and second cooling chamber, which partial cooling chamber preferably surrounds at least one intake port and/or exhaust port, wherein the partial cooling chamber is separated from the first cooling water chamber by an intermediate deck, and wherein the partial cooling chamber is flow-connected via at least one second flow transfer in the intermediate deck to the first cooling water chamber.

In order to enable precisely defined heat dissipation in the region of the central component, it is advantageous if an annular gap is formed between the intermediate deck and the central component or a sleeve accommodating the central component, wherein an annular baffle is arranged in the annular gap, wherein the annular baffle is preferably fixedly connected to the sleeve. The baffle can be arranged as a metal or plastic baffle.

The cooling system with the two cooling circuits is thus integrated in the cast parts of the cylinder housing or the single-cylinder head.

The two cooling circuits can principally be operated at the same temperature.

It is especially advantageous however if the two cooling circuits have different temperature levels, wherein the first cooling circuit is arranged as a high-temperature circuit and the second cooling circuit as a low-temperature circuit, wherein the low-temperature circuit has a lower temperature level than the high-temperature circuit.

The high-temperature circuit is formed by the first cooling circuit, which has an entrance temperature into the first coolant jacket of approximately 85° C. The coolant flows around the cylinder liner in the upper region in order to adequately ensure the cooling of the top land ring region and the piston ring region in the area of the first piston ring groove, and flows thereafter via the first transfer opening to the first cooling chamber of the single-cylinder head.

The second cooling circuit forms the low-temperature circuit which is controlled with respect to temperature in such a way that the entrance temperature into the second cooling jacket lies approximately at 50° to 70° C. The coolant flows through the fire deck in the single-cylinder head in a normal plane arranged substantially normally to the cylinder axis. The cooling boreholes and cooling channels are arranged very close to the combustion chamber roof of the single-cylinder head and thus also supply the valve seat rings of the intake and exhaust valves with coolant. The flow is directed towards the centre of the single-cylinder head, and is deflected in the region of the injector sleeve by means of a baffle and thereafter flows through the bottom partial cooling chamber of the single-cylinder head in the opposite direction to the connecting boreholes radially to the outside. The flows of the first cooling circuit and the second cooling circuit are combined in a purposeful fashion in the region of the upper first cooling chamber and then exit jointly from the cylinder head at the opening to the water collecting line. The coolant of the second cooling circuit can be taken from the first cooling circuit. Mixing of both cooling circuits is enabled by arranging at least one mixing valve between the first cooling circuit and the second cooling circuit (before entrance into the cooling jackets of the cylinder housing). As a result, hot water of the first cooling circuit can be mixed into the second cooling circuit in the case of a cold internal combustion engine or in idle operation, wherein the mixing valve can be controlled in a temperature-dependent manner.

As a result of two separate cooling circuits are provided in the cylinder housing and the two separate cooling flow guides in the single-cylinder head, regions of the top land, the fire deck and around the intake and exhaust ports in the single-cylinder head can be cooled separately and in a purposeful manner with the respectively optimal coolant temperature.

BRIEF DESCRIPTION OF THE DRAWINGS

The invention will be explained below in greater detail by reference to the drawings, wherein.

DETAILED DESCRIPTION OF THE DEPICTED EMBODIMENTS

Figures 1, 2:
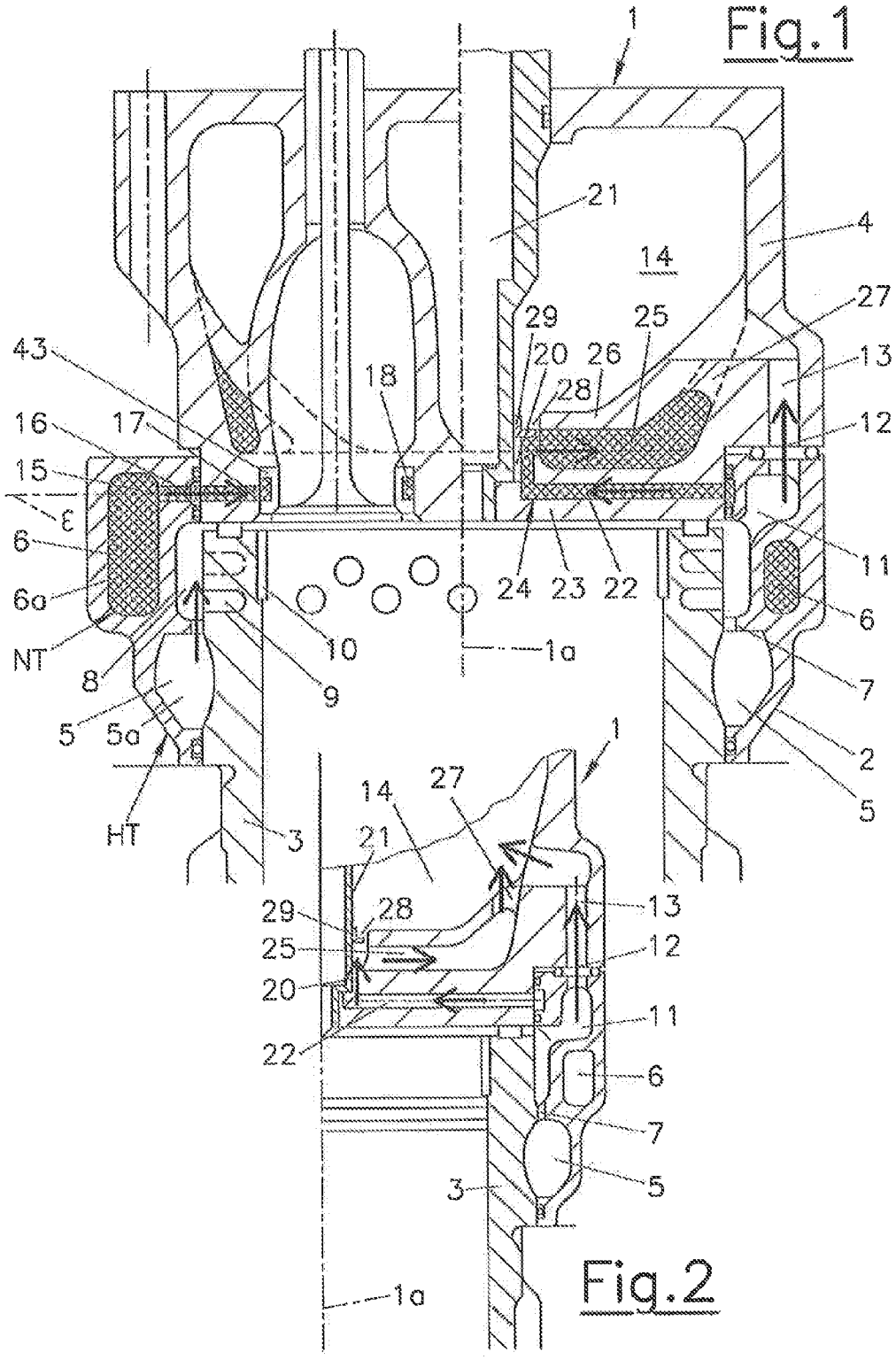
FIG. 1 shows an internal combustion engine in accordance with the invention in a longitudinal sectional view in a first embodiment.
FIG. 2 shows this internal combustion engine in a meridian section.
Figure 3:
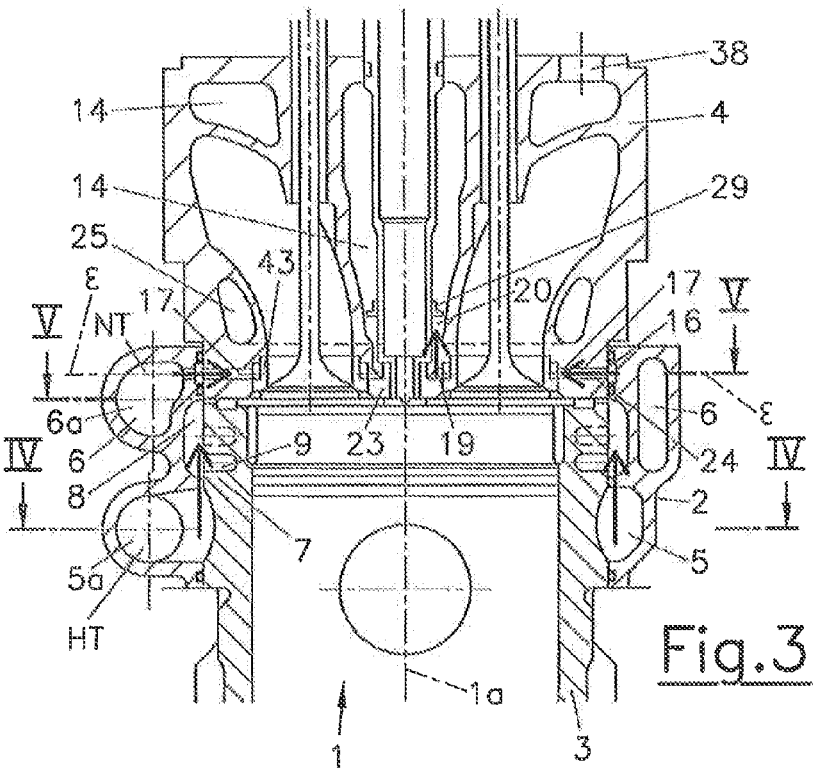
FIG. 3 shows an internal combustion engine in accordance with the invention in a second embodiment in a meridian section.
Figure 4:
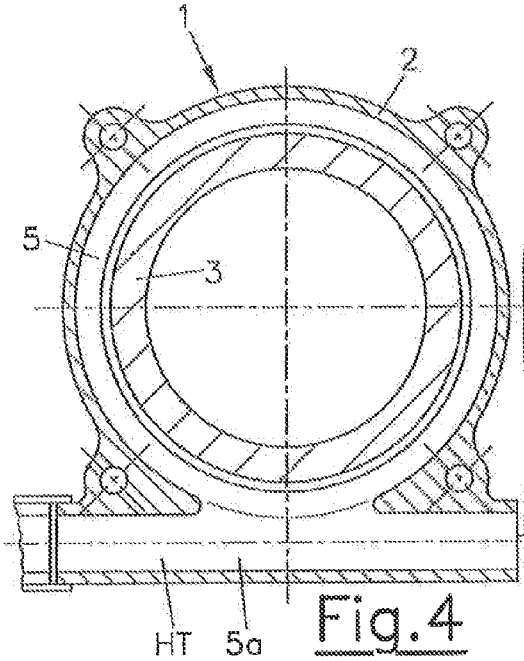
FIG. 4 shows this internal combustion engine in a sectional view along the line IV-IV in FIG. 3.
Figure 5:
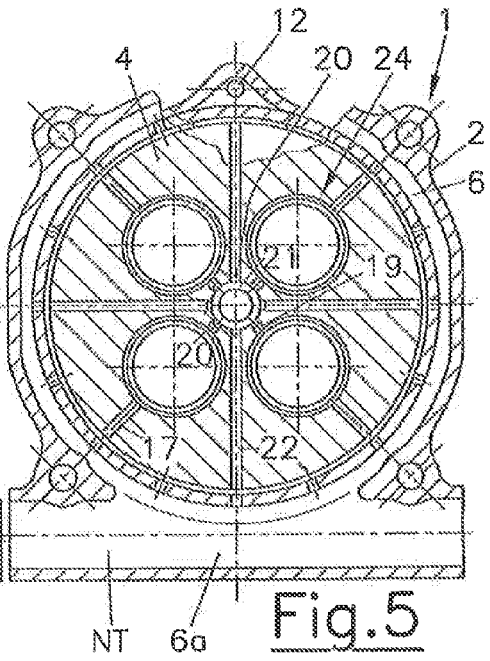
FIG. 5 shows this internal combustion engine in a sectional view along the line V-V in FIG. 3.

The internal combustion engine comprises several single cylinders 1, wherein each single cylinder 1 comprises a cylinder housing 2 and a cylinder liner 3, The cylinder housing 2 is closed off at the top by a single-cylinder head 4.

The cylinder liner 3 is surrounded by a first cooling jacket 5 and a second cooling jacket 6, wherein the first cooling jacket 5 and the second cooling jacket 6 belong to different cooling circuits 31, 32 and are separated within the cylinder housing 2, so that the cooling media are supplied separately to the single-cylinder head 4. The first cooling jacket 5 originates from a first supply channel 5*a* of the first cooling circuit 31, and the second cooling jacket 6 from a second supply channel 6*a* of the second cooling circuit 32, The first cooling jacket 5 surrounds the cylinder liner 3 and is in flow connection via an annular first flow transfer 7 with an annular first cooling channel 8 and tangential milled recesses 9 or radial blind holes or radial through-holes in the cylinder liner 3 for cooling the top land ring region 10. A transfer channel 11 originates from the annular first cooling channel 8, which transfer channel opens into the first cooling chamber 14 via a first transfer opening 12 and a riser channel 13 arranged substantially parallel to the cylinder axis 1*a*. The annular first channel region 8 is surrounded by the second cooling jacket 6 which is formed into the cylinder housing 2. The second cooling jacket 6 is flow-connected via a second transfer channel 15 and at least one second transfer opening 16, which is annular for example, between the cylinder housing 2 and the single-cylinder head 4 as well as radial first connecting boreholes 17 to annular second cooling channels 18 for cooling the valve seat rings 43, The second cooling channels 18 are connected via radial connecting channels 19 to at least one axial connecting channel 20, which is arranged in the direction of the cylinder axis 1*a* adjacent to a sleeve 21 for accommodating a central component such as an injection nozzle. Furthermore, the second cooling jacket 6 is connected via radial second connecting boreholes 22 to at least one axial connecting channel 20. The second cooling channels 18 and the first and second connecting boreholes 17 and 22 are substantially arranged in a normal plane 6 in the fire deck 23 of the single-cylinder head 4, and form together with the axial connecting channels 20 the second cooling chamber 24 supplied by the second cooling circuit 32.

The axial connecting channels 20 are connected to a bottom partial cooling chamber 25, which is separated by an intermediate deck 26 from the first cooling chamber 14 which is situated above. The partial cooling chamber 25 is in connection with the first cooling chamber 14 via a second flow transfer 27.

The axial and radial connecting channels 19, 20 are preferably formed by boreholes.

An annular gap 28 is formed between the intermediate deck 26 and the sleeve 21, in which an annular baffle 29 made of metal or plastic is inserted. The baffle 29 can be connected rigidly to the sleeve 21, e.g. welded or glued.

Figure 6:
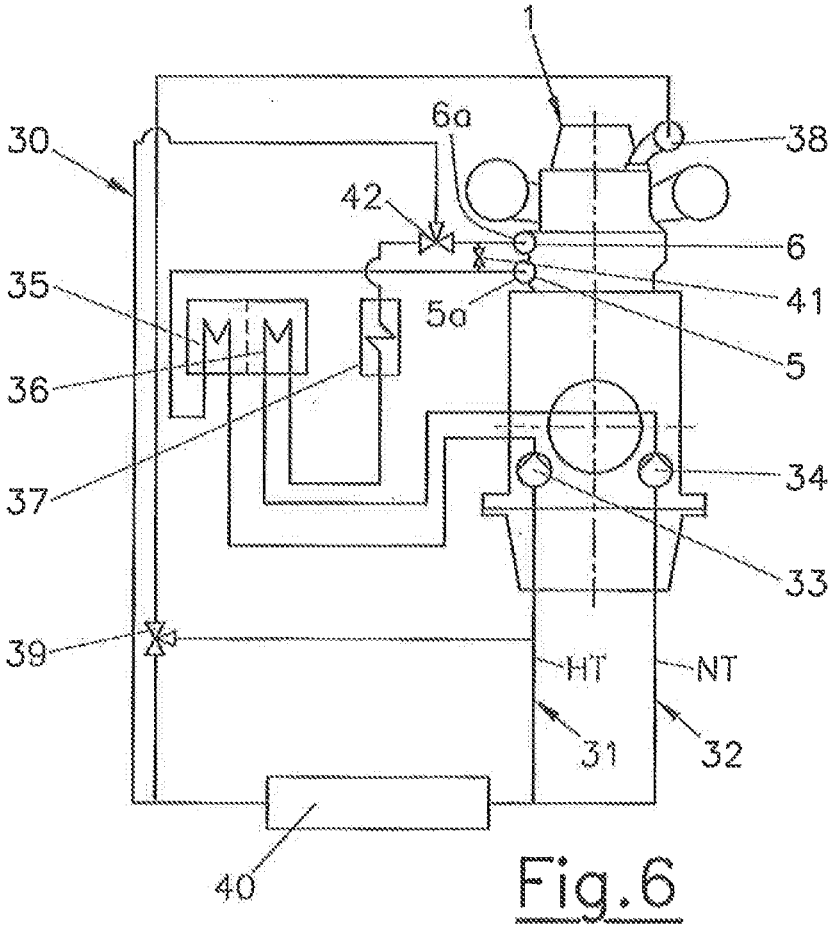
FIG. 6 shows the cooling system of the internal combustion engine in accordance with the invention.

FIG. 6 schematically shows the coolant system 30 of the internal combustion engine. The coolant system 30 comprises a first cooling circuit 31 and a second cooling circuit 32, wherein the first cooling circuit 31 is arranged as a high-temperature circuit HT and the second cooling circuit 32 as a low-temperature circuit NT. A first coolant pump 33 is arranged in the first cooling circuit 31, and a second coolant pump 34 in the second cooling circuit 32. The coolant of the first cooling circuit 31 flows from the first coolant pump 33 to a first intercooler 35 arranged as a high-temperature intercooler, and reaches from the said intercooler to the first cooling jacket 5 of the cylinder housing 2. The coolant of the second cooling circuit 32 is conveyed by the second coolant pump 34 to the second intercooler 36 which is arranged as a low-temperature intercooler, from which it is supplied via the oil cooler 37 to the second cooling jacket 6. The coolant flows through the cooling chambers of the cylinder housing 2 and the single-cylinder head 4 in the manner as described above, wherein the flows of the two cooling circuit 31, 32 combine in the single-cylinder head 4 and leave the single-cylinder head 4 again via a common coolant collecting line 38. The coolant reaches a central unit cooler 40 via a thermostatic valve 39. The coolant flows are divided into the two partial flows of the first cooling circuit 31 and the second cooling circuit 32 downstream of the unit cooler 40.

The cooling circuit 31 is operated at approximately 85° C. (entrance temperature to the first cooling jacket 5), wherein the coolant flows around the cylinder liner 3 in the upper region in order to sufficiently cool the top land ring region 10 and the region of the first groove 9 of the piston ring area. The coolant of the first cooling circuit 31 then flows in the region of the first transfer opening 12 to the single-cylinder head 4.

The second cooling circuit 32 is controlled with respect to temperature in such a way that the entrance temperature into the second cooling jacket 6 lies in the range of between 50° C. to 70° C. The coolant of the second cooling circuit 32 flows through the fire deck 23 of the single-cylinder head 4 substantially in a normal plane E on the cylinder axis 1*a*. The second cooling channels 18 and distributor boreholes 17 and 22 are arranged in the region of a normal plane E on the cylinder axis 1*a* close to the combustion chamber roof of the single-cylinder head 4 and cool the valve seat rings 43 of the intake and exhaust valves. The flow is directed radially in the direction towards the centre of the single-cylinder head 4, is deflected in the region of the sleeve 21 by means of the baffle 29, and flows through the bottom partial cooling chamber 25 in the opposite direction to the distributor boreholes 17 and 22. The flows of the first and second cooling circuit 31, 32 are joined in a purposeful fashion in the region of the upper first cooling chamber 14 and then exit jointly through the collecting line 38 from the single-cylinder head 4. The second cooling circuit 32 can branch off from the low-temperature cooling circuit NT before entrance to the second coolant jacket 6. Mixing of the two cooling circuits 31, 32 is enabled by the arrangement of the mixing valve 41 between the first and second cooling circuit 31, 32. For example, hot water from the high-temperature circuit HT can be mixed into the low-temperature circuit NT in the case of a cold internal combustion engine or in idling operation. The mixing valve 41 and the control valve 42 can be controlled in a temperature-dependent manner.

The invention claimed is:

1. An internal combustion engine, comprising at least one first and one second cooling circuit, at least one single cylinder with a cylinder housing which accommodates a cylinder liner, and at least one single-cylinder head, wherein the cylinder liner is surrounded by a first and second cooling jacket, wherein the first cooling jacket is separated with respect to flow from the second cooling jacket within the cylinder housing, wherein the first cooling jacket is flow-connected to at least one first cooling chamber, and the second cooling jacket is flow-connected to at least one second cooling chamber in the single-cylinder head.

2. The internal combustion engine according to claim 1, wherein the first cooling jacket is flow-connected via at least one first flow transfer within the cylinder housing to at least one annular first cooling channel which surrounds the top land region of the cylinder liner.

3. The internal combustion engine according to claim 2, wherein the first flow transfer is shaped annular.

4. The internal combustion engine according to claim 2, wherein the first cooling channel is shaped annular.

5. The internal combustion engine according to claim 2, wherein the first cooling channel is arranged at least in part between the first cooling jacket and the single-cylinder head.

6. The internal combustion engine according to claim 2, wherein the cylinder liner comprises at least one radial blind hole originating from the first cooling channel, a through-hole or a tangential milled recess.

7. The internal combustion engine according to claim 2, wherein the first cooling channel is flow-connected via at least one transfer opening between the cylinder housing and the single-cylinder head to the first cooling chamber in the single-cylinder head.

8. The internal combustion engine according to claim 2, wherein the second cooling jacket substantially surrounds the first cooling channel.

9. The internal combustion engine according to claim 1, wherein the first cooling jacket is formed at least in part by the cylinder housing and in part by the cylinder liner.

10. The internal combustion engine according to claim 1, wherein the second cooling jacket is formed by the cylinder housing.

11. The internal combustion engine according to claim 1, wherein the second cooling jacket is flow-connected via at least one second overflow opening between the cylinder housing and the single-cylinder head to at least one second cooling chamber in the single-cylinder head.

12. The internal combustion engine according to claim 11, wherein the second overflow opening is shaped annular.

13. The internal combustion engine according to claim 1, wherein the second cooling chamber comprises at least one annular second cooling channel which surrounds a valve seat ring.

14. The internal combustion engine according to claim 13, wherein the second cooling channel is arranged in a normal plane on the cylinder axis in the fire deck of the single-cylinder head.

15. The internal combustion engine according to claim 1, wherein the second cooling chamber comprises at least one axial connecting channel.

16. The internal combustion engine according to claim 15, wherein the axial connecting channel is arranged parallel to the cylinder axis.

17. The internal combustion engine according to claim 15, wherein the axial connecting channel is arranged adjacent to a central component opening into the combustion chamber of the single cylinder, or to a sleeve which accommodates said channel.

18. The internal combustion engine according to claim 17, wherein the central component opening into the combustion chamber is an injector.

19. The internal combustion engine according to claim 17, wherein the axial connecting channel is flow-connected via at least one radial connecting channel to at least one second cooling channel.

20. The internal combustion engine according to claim 19, wherein the radial connecting channel is arranged in a normal plane on the cylinder axis in the fire deck of the single-cylinder head.

21. The internal combustion engine according to claim 15, wherein the axial connecting channel is flow-connected to at least one partial cooling chamber in the single-cylinder head, which partial cooling chamber is arranged between the first and second cooling chamber and which preferably surrounds at least one intake port and/or exhaust port.

22. The internal combustion engine according to claim 21, wherein the partial cooling chamber surrounds at least one intake port and/or exhaust port.

23. The internal combustion engine according to claim 22, wherein the partial cooling chamber is connected via at least one second flow transfer in the intermediate deck to the first cooling chamber.

24. The internal combustion engine according to claim 21, wherein the partial cooling chamber is separated from the first cooling chamber by an intermediate deck.

25. The internal combustion engine according to claim 24, wherein an annular gap is formed between the intermediate deck and the central component or a sleeve accommodating the central component.

26. The internal combustion engine according to claim 25, wherein an annular baffle is arranged in the annular gap.

27. The internal combustion engine according to claim 26, wherein the annular baffle is fixedly connected to the sleeve.

28. The internal combustion engine according to claim 27, wherein the baffle is formed by a metal or plastic ring.

29. The internal combustion engine according to claim 1, wherein the second cooling chamber comprises at least one radial connecting borehole in the fire deck of the single-cylinder head, wherein preferably at least one connecting borehole opens into the second cooling channel or the axial connecting channel.

30. The internal combustion engine according to claim 29, wherein at least one connecting borehole opens into the second cooling channel or the axial connecting channel.

31. The internal combustion engine according to claim 29, wherein the connecting borehole is arranged in a normal plane on the cylinder axis in the fire deck of the single-cylinder head.

32. The internal combustion engine according to claim 1, wherein the first cooling jacket is connected to the first cooling circuit and the second cooling jacket is connected to the second cooling circuit.

33. The internal combustion engine according to claim 32, wherein the first cooling jacket is connected to the first cooling circuit and the second cooling jacket is connected to the second cooling circuit on the input side.

34. The internal combustion engine according to claim 1, wherein the first cooling circuit is arranged as a high-temperature circuit and the second cooling circuit is arranged as a low-temperature circuit.

35. The internal combustion engine according to claim 1, wherein a first coolant pump and a first intercooler are arranged in the first cooling circuit, wherein the low-temperature circuit has a lower temperature level than the high-temperature circuit.

36. The internal combustion engine according to claim 1, wherein a second coolant pump and a second intercooler are arranged in the second cooling circuit.

37. The internal combustion engine according to claim 36, wherein also an oil cooler is arranged in the second cooling circuit.

38. The internal combustion engine according to claim 1, wherein the first and second cooling circuit are connectable to each other via at least one bypass valve or mixing valve prior to an entrance into the first or second cooling jacket of the cylinder housing.

39. The internal combustion engine according to claim 1, wherein media of the first and second cooling circuit are joined within the single-cylinder head.

40. The internal combustion engine according to claim 1, wherein the first and second cooling circuit branch off a common cooling circuit downstream of a central cooler.

41. The internal combustion engine according to claim 1, wherein the first and second cooling circuit have the same temperature level before an entrance into the first or second cooling jacket.

42. The internal combustion engine according to claim 1, wherein the internal combustion engine is a large diesel engine.

* * * * *